US009283423B2

(12) United States Patent
Dickerson

(10) Patent No.: US 9,283,423 B2
(45) **Date of Patent: *Mar. 15, 2016**

(54) TECHNIQUE PLATE

(76) Inventor: Mercedes L. Dickerson, Hayward, CA (US)

( * ) Notice: Subject to any disclaimer, the term of this patent is extended or adjusted under 35 U.S.C. 154(b) by 67 days.

This patent is subject to a terminal disclaimer.

(21) Appl. No.: 13/411,258

(22) Filed: Mar. 2, 2012

(65) Prior Publication Data

US 2012/0165166 A1 Jun. 28, 2012

Related U.S. Application Data

(63) Continuation of application No. 12/795,470, filed on Jun. 7, 2010, now Pat. No. 8,128,539, which is a continuation-in-part of application No. 12/131,823, filed on Jun. 2, 2008, now abandoned.

(51) Int. Cl.

| | |
|---|---|
| ***A63B 21/06*** | (2006.01) |
| ***A63B 21/00*** | (2006.01) |
| ***A63B 21/072*** | (2006.01) |
| ***A63B 21/075*** | (2006.01) |
| ***A63B 23/00*** | (2006.01) |
| ***A63B 23/12*** | (2006.01) |
| *A63B 23/035* | (2006.01) |

(52) U.S. Cl.

CPC ..... *A63B 21/0724* (2013.01); *A63B 21/0615* (2013.01); *A63B 21/075* (2013.01); *A63B 23/12* (2013.01); *A63B 21/4035* (2015.10); *A63B 23/03525* (2013.01); *A63B 23/1209* (2013.01); *A63B 2209/00* (2013.01)

(58) Field of Classification Search

CPC ..... A63B 21/075; A63B 21/0724; A63B 21/0615; A63B 23/12; A63B 2209/00; A63B 2209/02; A63B 2209/023; A63B 2209/026; A63B 2209/14; A63B 21/06; A63B 21/0601; A63B 21/0604; A63B 21/0607; A63B 21/072; A63B 21/0728

USPC ..... 482/92–108; 428/411.1; 264/36.14

See application file for complete search history.

(56) References Cited

U.S. PATENT DOCUMENTS

| | | | | |
|---|---|---|---|---|
| 4,484,740 | A * | 11/1984 | Green | 482/105 |
| 5,203,753 | A * | 4/1993 | Rothhammer | 482/111 |
| 5,407,413 | A * | 4/1995 | Kupferman | 482/106 |
| 5,853,355 | A * | 12/1998 | Standish | 482/106 |
| 6,436,015 | B1 * | 8/2002 | Frasco et al. | 482/106 |
| 2005/0281999 | A1 * | 12/2005 | Hofmann et al. | 428/304.4 |
| 2007/0184943 | A1 * | 8/2007 | Davies | 482/93 |
| 2007/0197352 | A1 * | 8/2007 | Charniga et al. | 482/93 |
| 2009/0050768 | A1 * | 2/2009 | Campbell | 248/346.01 |
| 2010/0022359 | A1 * | 1/2010 | Lin | 482/93 |
| 2012/0258846 | A1 * | 10/2012 | Wilson | 482/141 |

OTHER PUBLICATIONS

Dated Feb. 26, 2009; "Training for the British Masters Weightlifting Championships"; http://www.colinmcnulty.com/blog/2009/02/26training-for-the-british-masters-weightlifting-championships, 4 pages.

* cited by examiner

*Primary Examiner* — Oren Ginsberg
*Assistant Examiner* — Joshua Lee
(74) *Attorney, Agent, or Firm* — Shook, Hardy & Bacon

(57) ABSTRACT

A technique plate is usable to engage in various exercise activities, such as weightlifting movements. The technique plate may include various elements, such as a weight amount and a diameter, which is consistent with Olympic-weightlifting standards.

18 Claims, 8 Drawing Sheets

TECHNIQUE PLATE

CROSS-REFERENCE TO RELATED APPLICATIONS

This application is a continuation of U.S. Ser. No. 12/795,470, filed on Jun. 7, 2010. U.S. Ser. No. 12/795,470 is a continuation-in-art of U.S. Ser. No. 12/131,823, filed Jun. 2, 2008.

FIELD OF THE INVENTION

The present invention relates to weightlifting systems and apparatuses including a technique weightlifting plate.

BACKGROUND OF THE INVENTION

Often weightlifting systems include a bar with removable plates of varying weight amounts.

A bar loaded with plates can be used to execute various movements, such as lifts carried out when engaging in Olympic-style weightlifting. The snatch and clean-and-jerk are examples of competition lifts executed in Olympic-style weightlifting. In both the snatch and the clean-and-jerk, a lifter must lift the bar loaded with weights from a platform to an overhead position. For example, when executing the snatch, a lifter moves the bar from the platform to overhead (i.e., arms locked out) in a single movement. Alternatively, the clean-and-jerk includes moving (i.e., cleaning) the bar from the platform to a "racked position" in which the bar is positioned near or across the deltoids and clavicle region. From the racked position, the bar is moved (i.e., jerked) to an overhead position with arms locked. The snatch and the clean-and-jerk are merely examples of lifts that require such movement of the bar, and a variety of other movements may be executed using a bar loaded with weights in which the bar is moved from a platform to an elevated position.

Weightlifting movements can require good technique and focus in order to be executed. For example, a lifter's starting position (e.g., FIG. 4) will often determine whether the lift is successful. That is, an incorrect starting position can often cause a lift to fail. As such, it can be important for the bar to be positioned at a correct height off of the ground in order to assist the lifter achieve a good starting position.

It is not uncommon for the bar to be dropped while a lifter is executing a lift and to strike a floor or platform. For example, a lifter may fail to complete a lift, in which case the lifter drops the bar mid-lift and the bar strikes the floor. In addition, a lifter may drop the weight after a lift has been executed, such as from a racked position or from an overhead position. As such, it can be important that plates loaded on the bar be made of a material that will not damage the platform or the bar.

FIG. 1 depicts drawbacks of some conventional technique plates 10, which may be made from rubber. Conventional technique plates 10 may include other materials as well, such as a metal plate (e.g., iron plate) that is encased by the rubber or a metal ring positioned in a bar-receiving hole of the plate. The conventional technique plate 10 depicted in FIG. 1 is problematic because it bends, thereby making it difficult to achieve a proper starting position or setup useful for learning proper technique.

FIG. 2 is a diagram of other conventional technique plates 20. These technique plates 20 are made thin in order to achieve a light weight and low mass for weightlifting training. These technique plates 20 are hexagonal shaped to enable them to stand up. However, these technique plates 20 cannot be dropped, which is not good for learning weightlifting technique.

SUMMARY OF THE INVENTION

Embodiments of the invention are defined by the claims below, not this summary. This summary provides an overview of the disclosure and introduces a selection of concepts that are further described in the detailed-description section below. This summary is not intended to identify key features or essential features of the claimed subject matter, nor is it intended to be used as an aid in isolation to determine the scope of the claimed subject matter.

An embodiment of the invention includes a technique plate that is usable to engage in exercise activities, such as weightlifting movements. The technique plate may include various elements, such as a weight amount and a diameter, which is consistent with Olympic-weightlifting standards.

BRIEF DESCRIPTION OF THE DRAWINGS

Illustrative embodiments of the present invention are described in detail below with reference to the attached drawing figures, which are incorporated herein, wherein.

DETAILED DESCRIPTION OF THE INVENTION

The present invention relates to weightlifting systems, and more particularly to weightlifting system that uses a weightlifting technique plate for improving weightlifting technique. The following description is presented to enable one of ordinary skill in the art to make and use the invention, and is provided in the context of a patent application and its requirements. Various modifications to the preferred embodiment and the generic principles and features described herein will be readily apparent to those skilled in the art. Thus, the present invention is not intended to be limited to the embodiments shown, but is to be accorded the widest scope consistent with the principles and features described herein.

A weightlifting technique plate for improving weightlifting training is disclosed. The weightlifting technique plate (also referred to herein as a "technique plate") is a plate formed as one piece of solid plastic and includes a hole that is configured to receive a bar. The technique plate is used in a weightlifting system. According to the apparatus disclosed herein, the technique plate is rugged and stable. To more particularly describe the features of the present invention, refer now to the following description in conjunction with the accompanying figures.

Figure 3:
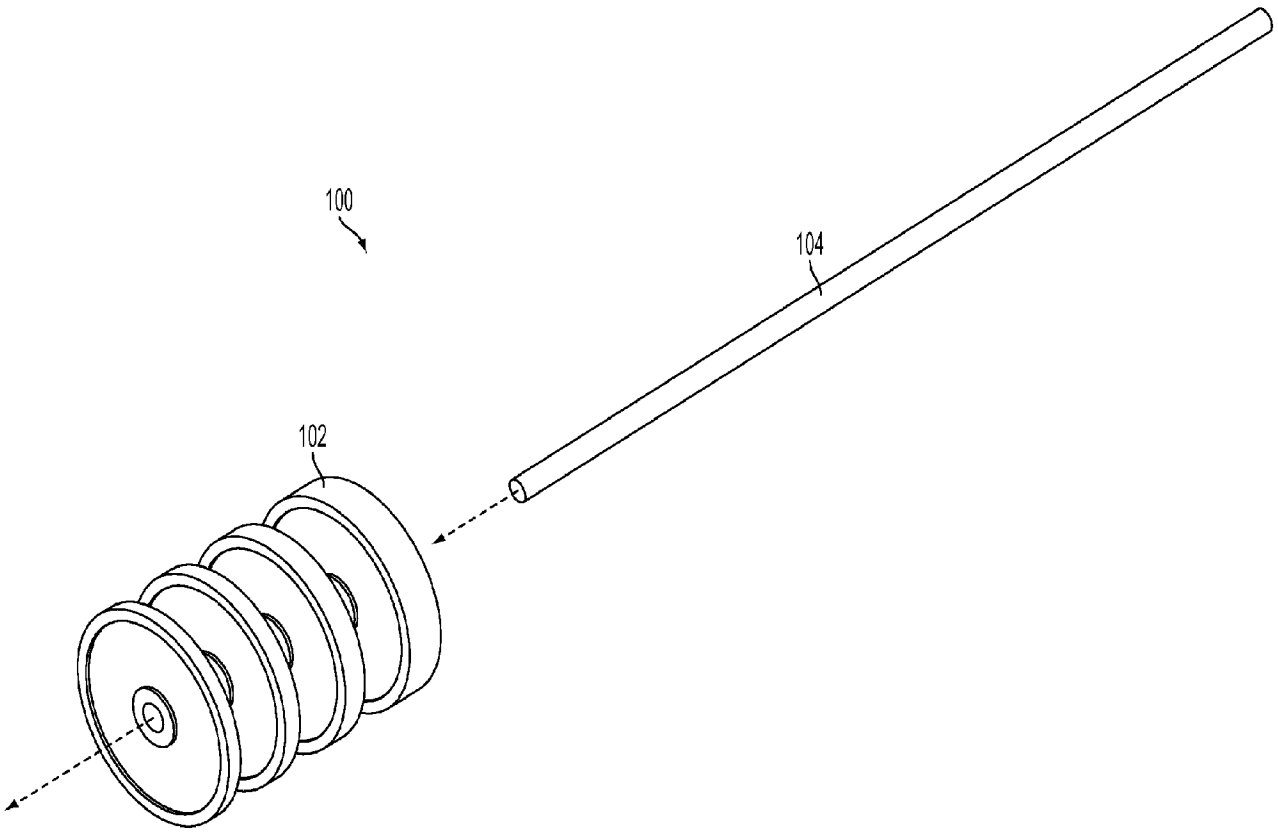
FIG. 3 is a diagram of a weightlifting system in accordance to one embodiment.

FIG. 3 is a diagram of a weightlifting system 100 in accordance to one embodiment. As FIG. 3 shows, the weightlifting system 100 includes a set of technique plates 102 and a bar 104. In one embodiment, the bar 104 is made of metal. The weightlifting system 100 is used for improving weightlifting training technique for weight lifters. In one embodiment, the each of the technique plates 102 is used for Olympic weightlifting. As such, the bar 104 may be an Olympic weightlifting barbell. In one embodiment, the technique plates 102 may be secured to the bar 104 using collars if desired.

In particular embodiments, the technique plates 102 are used as training tools in the sport of weightlifting as well as in Olympic weightlifting. As a training tool, the technique plates 102 teach the technique of weightlifting and enhance the technique of weightlifting. In one embodiment, the technique plates 102 are different from conventional weightlifting plates in that the technique plates 102 are the same size and shape as competition weightlifting plates but are lighter in weight than competition weightlifting plates. As such, it is understood that a size of competition weightlifting plates includes a diameter of approximately 450 millimeters (i.e., about 17.71 inches). Also, as described in more detail below, the technique plates 102 are rugged and thus will not break from impact when dropped on the floor.

Figure 4:
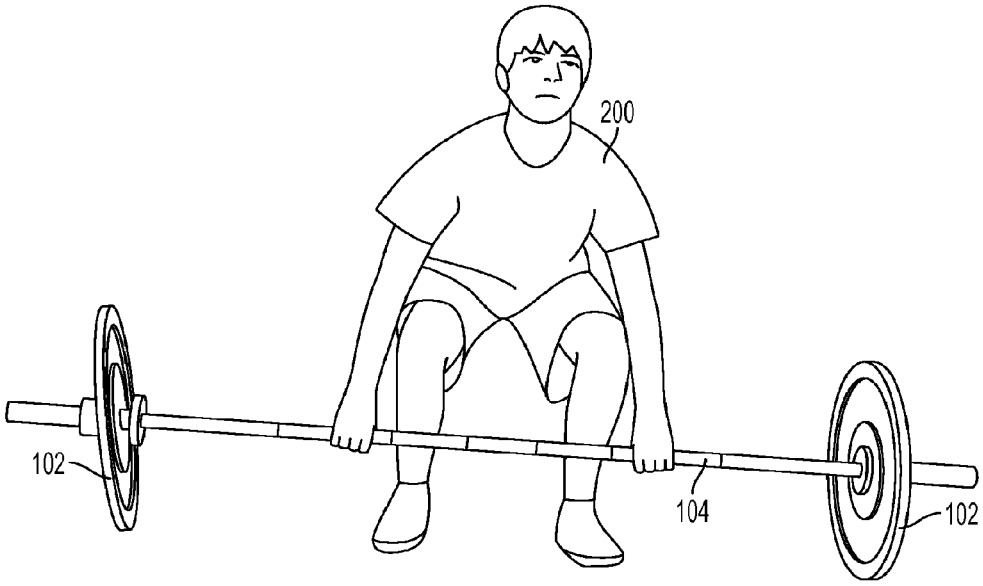
FIG. 4 is a diagram of a weightlifter at a start position just before lifting a bar with the technique plates in accordance to one embodiment.
Figure 5:
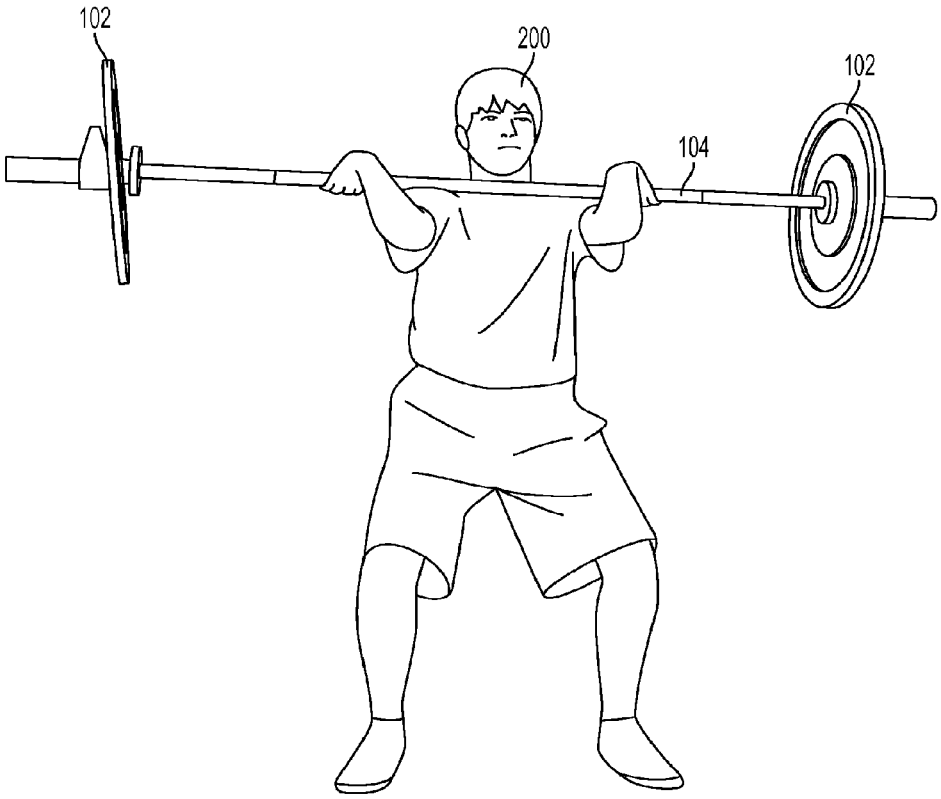
FIG. 5 is a diagram of a weightlifter at another position after lifting a bar with the technique plates in accordance to one embodiment.

FIG. 4 is a diagram of a weightlifter 200 at a start position just before lifting a bar 104 with the technique plates 102 in accordance to one embodiment. FIG. 5 is a diagram of the weightlifter 200 at a finish position after lifting the bar 104 with the technique plates 102 in accordance to one embodiment.

Figure 6:
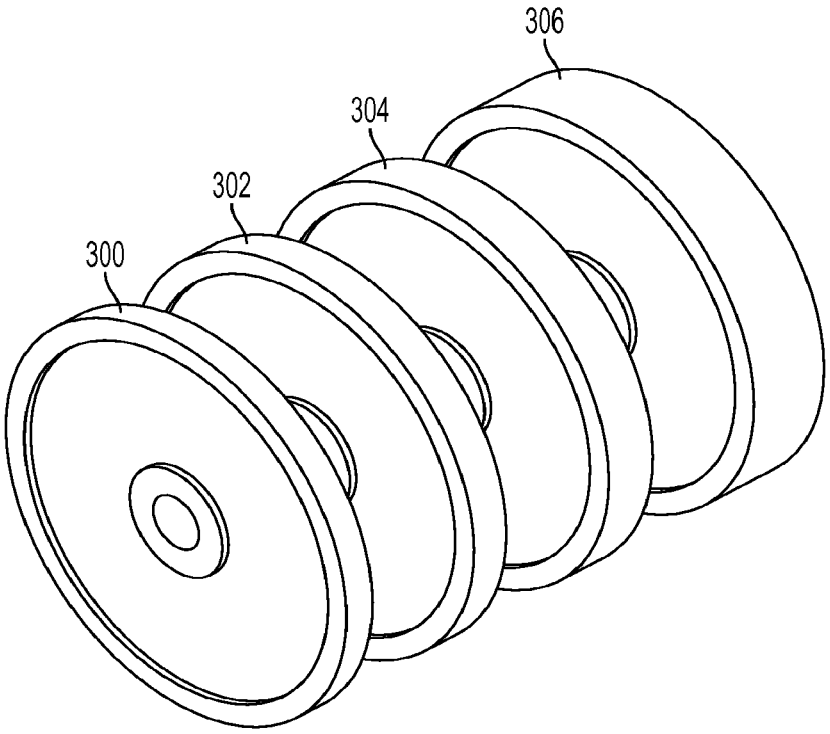
FIG. 6 is a diagram showing various technique plates in accordance to one embodiment.
Figure 7:
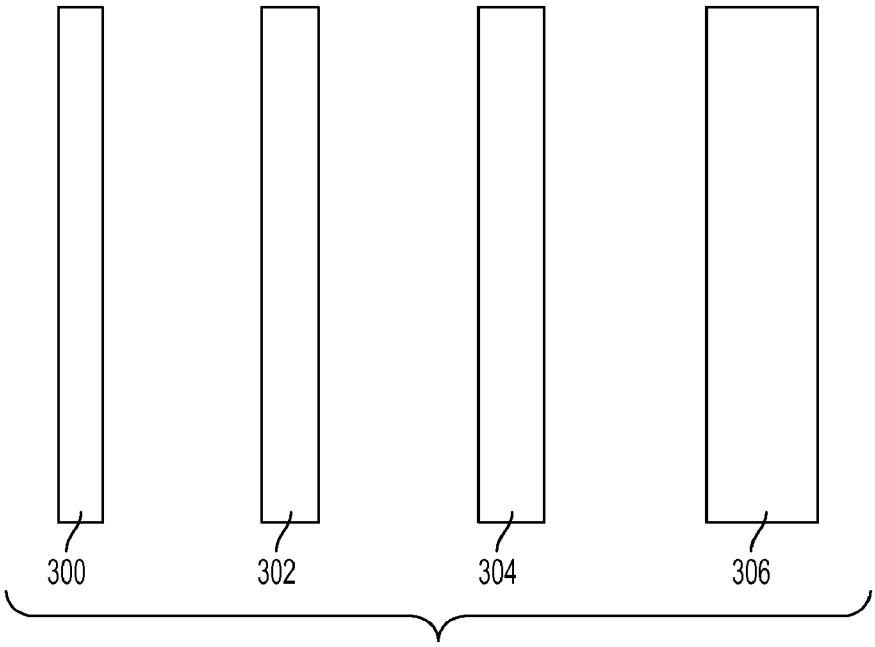
FIG. 7 is a side-view diagram of the technique plates in accordance to one embodiment.

FIG. 6 is a perspective-view diagram showing various technique plates 300, 302, 304, and 306 in accordance to one embodiment. FIG. 7 is a side-view diagram of the technique plates 300, 302, 304, and 306 in accordance to one embodiment. FIGS. 6 and 7 show plates, each having a different weight. In one embodiment, the plates have the same diameter regardless of weight. In one embodiment, each weight has a different color. In one embodiment, each technique plate ranges from 2.5 kilograms to 10 kilograms, where the thickness increases with weight. For example, technique plate 300 weighs 2.5 kilograms, technique plate 302 weighs 5 kilograms, technique plate 304 weighs 7.5 kilograms, technique plate 306 weighs 10 kilograms. In particular embodiments, the technique plates 300-306 are available in both pounds (e.g., USA) and kilograms (international), so as to be convenient for weightlifters and to be compatible with the style of the weight room. In one embodiment, each technique plate 300-306 is approximately 17½ inches in diameter, regardless of weight. In one embodiment, each technique plate 300-306 has a 2 inch center hole. In one embodiment, the technique plates fit all Olympic and competition bars.

Referring again to FIG. 3, at the novice level of weightlifting, the intensity used is low and the mass (e.g., weight) of the technique plates 102 are light. In one embodiment, as indicated above, the technique plates are the same size and shape as plates used for weightlifting competition. In a specific embodiment, the technique plates are the same size and shape as plates used for Olympic weightlifting competition (e.g., diameter of approximately 450 mm). Technique plates are particularly helpful for a beginner weightlifter, as higher-level lifters have little or no need for them.

In one embodiment, the technique plates are lighter in mass and in weight than conventional weightlifting plates. Conventional weightlifting plates are not only heavier than the technique plates 102, but conventional weightlifting plates are also not available in the same combination of weight (range), diameter size, and hole size as the technique plates 102. For example, conventional plates (also referred to as fractional plates) occur in the 2.5 kilograms to 10 kilograms range, but conventional plates do not exist in this range with a 17½ inch diameter. In particular embodiments, a plate of this dimension determine the starting height of the bar in competition. Because all of the technique plates have the 17½ inch diameter, the starting height of the bar is the same.

In one embodiment, each technique plate 102 is formed from a single piece of a plastic-based composite and molded by compression in special castings to meet a specific mass and shape for use with an Olympic lifting bar. In one embodiment, the special casting is designed in such a way to allow a single casting to be used for all sizes (or weights) of plate. In one embodiment, the special casting includes a negative mold of the technique plate. In one embodiment, the primary geometric difference between the different size technique plates, for achieving the different assigned weights of the technique plates, is the thickness each of the technique plates. In one embodiment, the thickness of the special casting may be adjusted to allow the thickness of the mold to be adjusted. This enables the formation of different size technique plates using the same mold. In other words, a single mold may be used to form all size technique plates.

As indicated above, in one embodiment, each of the technique plates 102 is formed from a single solid piece of compressed plastic. Because compressed plastic composite is very strong, a given technique plate 102 will not break apart, as there are no dissimilar materials other than the plastic composite. In one embodiment, plastic composite is composed of recycled plastics. In one embodiment, the technique plates have no toxins or recycled rubber odors. As such, the technique plates 102 are environmentally friendly.

In one embodiment, the technique plates 102 are rugged due to several structural characteristics. For example, as indicated above, in one embodiment, each technique plate 102 is formed from a single solid piece of compressed plastic. Having no dissimilar materials, the technique plates 102 will not come apart from impact when dropped on the ground. Furthermore, in one embodiment, technique plates 102 being made from compressed plastic makes the technique plates 102 very hard, and very difficult to break. In one embodiment, the ruggedness of the technique plate 102 make them very difficult to break even when fractional plates are added to them for progressive loading. The lower density allows more plastic to be used and still result in a light weight plate. Because of the lower density, the technique plates that are bigger in size are lighter than they appear. The result is a wider plate that does not teeter on the floor, and the fit at the hub does not allow the plate to wobble against the bar. As a result, a coach and weightlifter can focus on technique and not worry about damage from impact when the technique plates are dropped to the ground.

Figure 8:
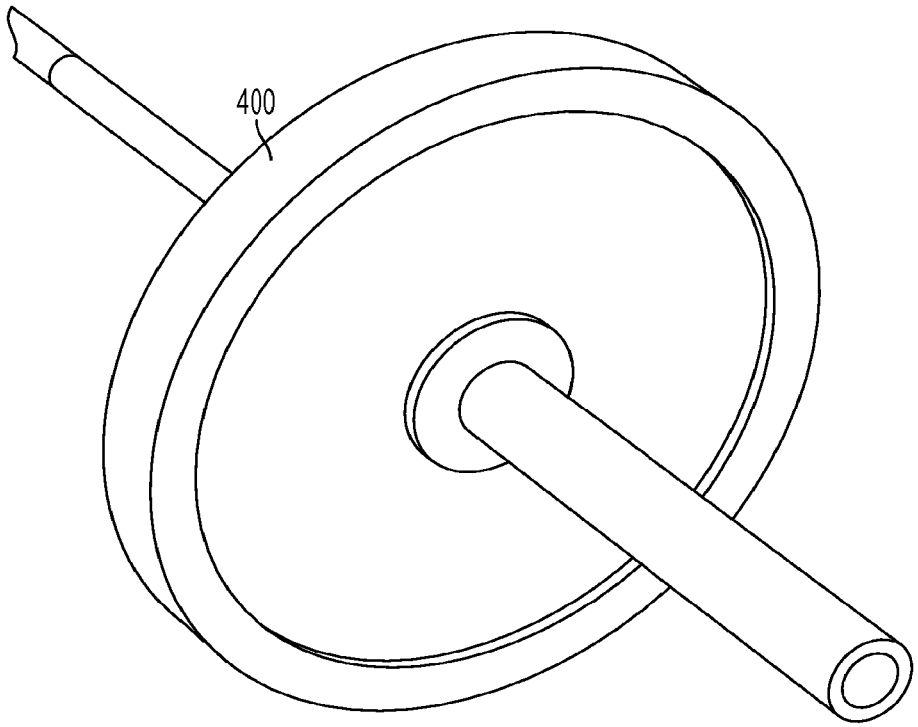
FIG. 8 is a diagram of a technique plate in accordance to one embodiment.

Because plastic composite is solid and rugged, the technique plates 102 will not become discolored from being use, thereby eliminating any need for painting. In one embodiment, the technique plates 102 have a chalky, speckled, or peppered appearance from the plastic composite mixture. FIG. 8 is a diagram of a technique plate 400 having a speckled appearance in accordance to one embodiment. This facilitates in distinguishing the technique plates 102 (FIG. 3) from conventional plates. It simplifies use in plate selection and verification of balanced bar loading. In one embodiment, the technique plates 102 include private/custom labeling to further distinguish them from conventional plates. In one embodiment, the technique plates 102 never need painting because of their chalky appearance. This makes the technique plates 102 look the same over time no matter how often they are used.

In one embodiment, the technique plates 102 have different colors depending on their weights. In one embodiment, the color is provided by the plastic-composite, and the plastic-composite enables the technique plates 102 to still be marbled, speckled, or chalky.

In one embodiment, because each technique plate 102 is made from compressed plastic, the technique plates 102 do not rust as metal plates do. As indicated above, each technique plate 102 is made of a single solid piece of plastic. Having no metal center (hub) prevents damage to the technique plate 102 and to the bar when the bar is dropped, which often occurs with metal hubs.

The one-piece construction of the technique plates 102 also eliminates problems such as stiction. Stiction may be defined as friction when two metals slide against each other that are associated with a metal hub around the center hole. The one-piece construction combined with the strength of the plastic composite also makes the hole (hub) of the technique plate 102 rugged.

Furthermore, in one embodiment, the technique plates 102 slide on and off the bar smoothly. Plastic by nature slides easily against the metal bar 104. As such, the technique plates 102 slide easily on and off the bar 104. In one embodiment, the center hub or boss of the technique plates 102, where the hole is located, is larger than the maximum thickness of the technique plate 102. This provides the widest load bearing surface area between the plastic of the technique plate 102 and the bar 104. This minimizes the wobbling and distributes the force and impact between the bar 104 and technique plate 102 from the action of lifting evenly throughout the thickness of the technique plate 102 across the depth of the hole. In one embodiment, the tolerance of the hole in the technique plate 102 is specified to allow for easy sliding the technique plate 102 on and off the bar 104 and use while lifting.

Figure 1:
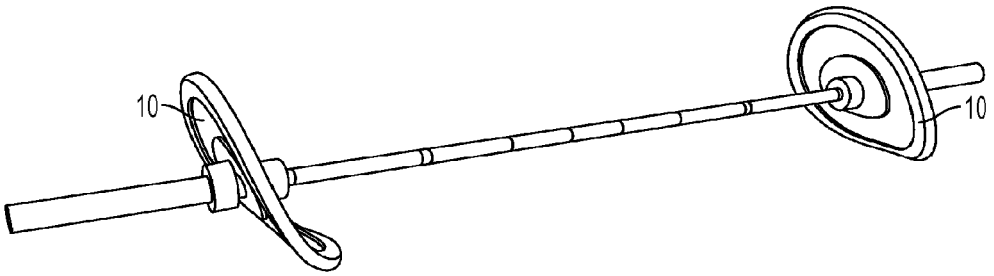
FIG. 1 PRIOR ART
FIG. 1 is a diagram of a conventional technique plates.
Figure 2:
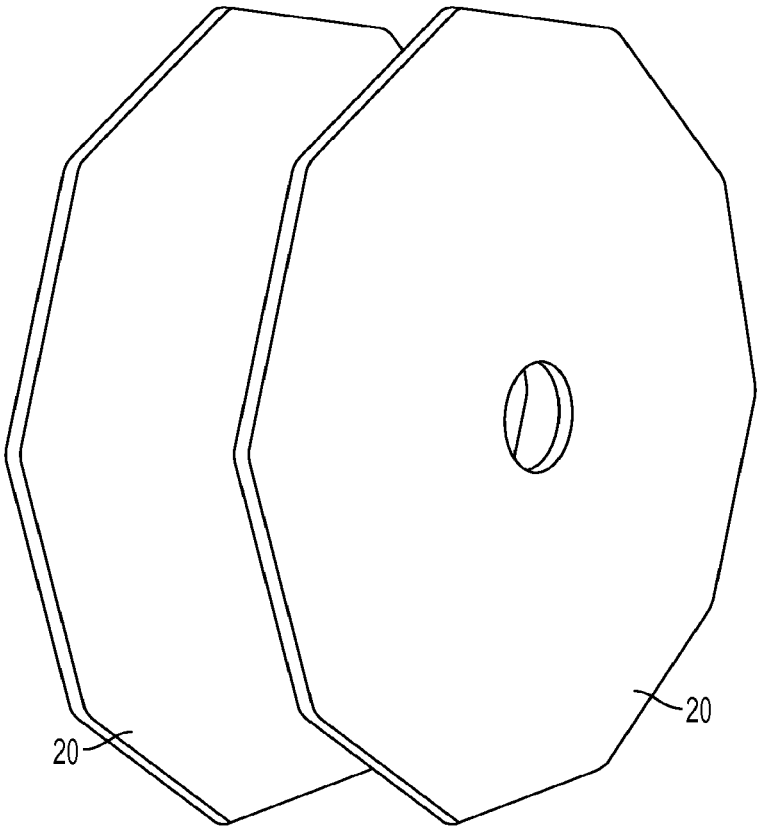
FIG. 2 PRIOR ART
FIG. 2 is a diagram of conventional technique plates.

In one embodiment, the hub or center hole of each technique plate 102 has a tolerance that fits closely to the bar to help eliminate wobble and bowing of the technique plate 102 when on the bar, and to eliminate slipping around when the bar is dropped. For example, to further prevent wobble, each technique plate 102 has a sufficient depth or thickness, wide enough to eliminate wobble and bowing of the technique plate 102 when on the bar 104. A hole that is too large would allow teetering of the technique plate 102 on the bar during lifts. Embodiments prevent this teetering, as the combination of the hole tolerance and the hole width is adjusted to maintain easy sliding with minimum teetering of the technique plate 102 on the bar 104. In one embodiment, the bar sits up evenly for the start of lift training (i.e., the bar is level relative to the ground). Referring again to FIG. 1, when one plate is bent or teetering, poor training technique is developed. The technique plates of the present invention prevent such poor technique and help to develop proper technique. At the beginner or novice level, weightlifting training requires high volume (e.g., many repetitions). As such, ease of placing and removing the technique plates 102 on and off the bar 104 application facilitates use and learning.

In one embodiment, the technique plates 102 are formed into competition sizes and shapes. For example, in one embodiment, each technique plate 102 may be formed with a 17½ inch diameter and with a 2 inch diameter center hole, which would fit all Olympic bars.

Because of the ruggedness of the technique plates 102 and their being secure when on the bar 104, a coach and weightlifter can better focus on technique without worrying about damaging the plates from being dropped on the floor. A coach and athlete can appreciate this aspect especially in the learning phase or technique phase of learning the sport of weightlifting.

Other benefits of the technique plates 102 is that they are easy to use and are overall less costly (being made from plastic) than conventional weightlifting plates.

According to the system and method disclosed herein, the present invention provides numerous benefits. For example, embodiments of the present invention provide a rugged, solid technique plate. Embodiments of the present invention also provide a technique plate that fits all Olympic bars. Also, using the costs of composite materials and processes associated with composite materials keeps costs lower than other manufactured technique plates.

A technique plate has been disclosed. The technique plate is a plate formed as one piece and includes a hole that is configured to receive a bar. The technique plate is used in a weightlifting system. According to the apparatus disclosed herein, the technique plate is rugged and stable enough be used with other fractional plates for progressive loading.

Many different arrangements of the various components depicted, as well as components not shown, are possible without departing from the scope of the claims below. Embodiments of our technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A weightlifting system comprising:

a weightlifting barbell including a first end and a second end; and a pair of technique plates each of which is configured to be loaded on a respective end of the weightlifting barbell, each of the technique plates comprising:

a weight amount of about 5 kilograms;

a circular configuration having a diameter of about 450 millimeters;

a portion that encircles a bar-receiving hole near a center of the circular configuration, wherein the portion includes a portion thickness that hinders wobbling of the technique plate when the technique plate is loaded on the weightlifting barbell by sliding the respective end through the bar-receiving hole; and a single-piece construction including a compressed plastic-based composite, wherein the compressed plastic-based composite includes a density level, which causes the technique plate to possess a combination of characteristics that include the weight amount of about 5 kilograms, the diameter of about 450 mm, and the portion thickness that hinders wobbling.

2. The weightlifting system of claim 1, wherein the single-piece construction includes no more than one composite material that is used to form a structure of the technique plate.

3. The weightlifting system of claim 1, wherein the single-piece construction does not include a metal ring near the portion.

4. The weightlifting system of claim 1, wherein the portion includes a hub surrounding the bar-receiving hole and wherein the hub is comprised of the compressed plastic-based composite.

5. The weightlifting system of claim 1, wherein the plastic-based composite includes a recycled-plastic-based composite.

6. The weightlifting system of claim 1, wherein, the combination of characteristics contributes to the technique plate not being damaged when the technique plate is positioned on the weightlifting barbell and the weightlifting barbell is dropped from at least a shoulder-level height of a user, such that the technique plate strikes a floor.

7. A weightlifting system comprising:

a weightlifting barbell including a first end and a second end; and a pair of technique plates each of which is configured to be loaded on a respective end of the weightlifting barbell, each technique plate comprising:

a weight amount of about 7.5 kg;

a circular configuration having a diameter of about 450 millimeters;

a portion that encircles a bar-receiving hole near a center of the circular configuration, wherein the portion includes a portion thickness that hinders wobbling of the technique plate when the technique plate is loaded on the weightlifting barbell by sliding the respective end through the bar-receiving hole; and a single-piece construction including a compressed plastic-based composite, wherein a density level of the compressed plastic-based composite causes the technique plate to possess a combination of characteristics that include the weight amount of about 7.5 kilograms, the diameter of about 450 millimeters, and the portion thickness that hinders wobbling.

8. The weightlifting system of claim 7, wherein the single-piece construction includes no more than one composite material that is used to form a structure of the technique plate.

9. The weightlifting system of claim 7, wherein the single-piece construction does not include a metal ring near the portion.

10. The weightlifting system of claim 7, wherein the portion includes a hub surrounding the bar-receiving hole and wherein the hub is comprised of the compressed plastic-based composite.

11. The weightlifting system of claim 7, wherein, the combination of characteristics contributes to the technique plate not being damaged when the technique plate is positioned on the weightlifting barbell and the weightlifting barbell is dropped from at least a shoulder-level height of a user, such that the technique plate strikes a floor.

12. A weightlifting system comprising:

a first pair of weightlifting technique plates including a first plate and a second plate, wherein the first plate and the second plate each includes:

a weight amount that is about 5 pounds;

a circular configuration having a diameter of about 17.7 inches;

a portion that encircles a bar-receiving hole near a center of the circular configuration, wherein the first plate is configured to be slidably loaded on a first end of a barbell and the second plate is configured to be slidably loaded on a second end of the barbell and wherein the portion includes a portion thickness that hinders wobbling of the first plate and the second plate when each plate is loaded on a respective end of the barbell; and a single-piece construction including a compressed plastic-based composite, wherein a density level of the compressed plastic-based composite causes the first plate and the second plate to each possess a combination of characteristics that include the weight amount about 5 pounds, the diameter of about 450 millimeters, and the portion thickness that hinders wobbling; and a second pair of weightlifting technique plates including a third plate and a fourth plate, wherein the third plate and the fourth plate each includes:

a weight amount that is about 10 pounds;

a circular configuration having a diameter of about 17.7 inches;

a portion that encircles a bar-receiving hole near a center of the circular configuration, wherein the third plate is configured to be slidably loaded on the first end of the barbell while the first plate is also loaded on the first end and the fourth plate is configured to be slidably loaded on the second end of the barbell while the second plate is also loaded on the second end and wherein the portion includes a portion thickness that hinders wobbling of the third plate and the fourth plate when each plate is loaded on a respective end of the barbell; and a single-piece construction including the compressed plastic-based composite, wherein the density level of the compressed plastic-based composite causes the third plate and the fourth plate to each possess a combination of characteristics that include the weight amount about 10 pounds, the diameter of about 450 millimeters, and the portion thickness that hinders wobbling.

13. The weightlifting system of claim 12, wherein the single-piece construction includes no more than one composite material that is used to form a structure of the plates.

14. The weightlifting system of claim 12, wherein the single-piece construction does not include a metal ring near the portion.

15. The weightlifting system of claim 12, wherein the portion includes a hub surrounding the bar-receiving hole and wherein the hub is comprised of the compressed plastic-based composite.

16. The weightlifting system of claim 12, wherein, the combination of characteristics contributes to the plates not being damaged when the plates are positioned on the barbell and the barbell is dropped from at least a shoulder-level height of a user, such that the plates strike a floor.

17. The weightlifting system of claim 1 further comprising:

another pair of technique plates that are loadable on the weightlifting barbell while the pair of technique plates are also loaded on the weightlifting barbell, wherein each technique plate in the other pair of technique plates includes:

a weight amount of at least 5 kilograms;

a circular configuration having a diameter of about 450 millimeters;

a portion that encircles a bar-receiving hole near a center of the circular configuration, wherein the portion includes a portion thickness that hinders wobbling of the technique plate when the technique plate is loaded on the weightlifting barbell by sliding the first end or the second end through the bar-receiving hole; and a single-piece construction including a compressed plastic-based composite, wherein the compressed plastic-based composite includes a density level, which causes the technique plate to possess a combination of characteristics that include the weight amount greater than 5 kilograms, the diameter of about 450 mm, and the portion thickness that hinders wobbling.

18. The weightlifting system of claim 7 further comprising:

another pair of technique plates that are loadable on the weightlifting barbell at the same time as the pair of technique plates, wherein each technique plate in the other pair of technique plates includes:

a weight amount less than 7.5 kilograms;

a circular configuration having a diameter of about 450 millimeters;

a portion that encircles a bar-receiving hole near a center of the circular configuration, wherein the portion includes a portion thickness that hinders wobbling of the technique plate when the technique plate is loaded on the weightlifting barbell by sliding the first end or the second end through the bar-receiving hole; and a single-piece construction including a compressed plastic-based composite, wherein the compressed plastic-based composite includes a density level, which causes the technique plate to possess a combination of characteristics that include the weight amount less than 7.5 kilograms, the diameter of about 450 mm, and the portion thickness that hinders wobbling.

* * * * *